US006135287A

United States Patent [19]

Hartwall

[11] Patent Number: 6,135,287

[45] Date of Patent: Oct. 24, 2000

[54] COLLAPSIBLE CONTAINER FOR TRANSPORT AND STORAGE OF FLUID AND PARTICULATE BULK GOODS

[75] Inventor: Peter Hartwall, Perstorp, Sweden

[73] Assignee: Perstorp AB, Perstorp, Sweden

[21] Appl. No.: 09/446,921

[22] PCT Filed: Jul. 2, 1998

[86] PCT No.: PCT/SE98/01301

§ 371 Date: Dec. 30, 1999

§ 102(e) Date: Dec. 30, 1999

[87] PCT Pub. No.: WO99/02412

PCT Pub. Date: Jan. 21, 1999

[30] Foreign Application Priority Data

Jul. 7, 1997 [SE] Sweden ..... 9702607

[51] Int. Cl.[7] ..... B65D 19/00

[52] U.S. Cl. ..... 206/600; 220/1.6

[58] Field of Search ..... 220/1.5, 1.6, 4.28, 220/4.29, 6, 7; 206/386, 600

[56] References Cited

U.S. PATENT DOCUMENTS 5,501,333 3/1996 Swan ..... 206/600 X 5,829,595 11/1998 Brown et al. ..... 206/600

FOREIGN PATENT DOCUMENTS 0306381 3/1989 European Pat. Off. .

0511781 11/1992 European Pat. Off. .

4443212 6/1996 Germany .

873129 1/1989 Norway .

2076463 12/1981 United Kingdom .

8605763 10/1986 WIPO .

9825833 6/1998 WIPO .

*Primary Examiner*—Jacob K. Ackun

*Attorney, Agent, or Firm*—Stevens, Davis, Miller & Mosher, L.L.P.

[57] ABSTRACT

Collapsible container (1) for fluent and particulate bulk goods, which container includes a carrying base part (20) which is provided with shock absorbing members (21), collapsible side walls (30) and preferably a lid. The side walls (30) are movably attached to the base part (20) via hinge parts (31). Adjacent side walls (30) are furthermore inter-connectable via a coupling which is angularly flexible around a vertical pivot axle. The lid (50) is mechanically connected with the side walls (30) so that forces can be absorbed in both the vertical and the horizontal plane.

10 Claims, 7 Drawing Sheets

Fig. 8.1
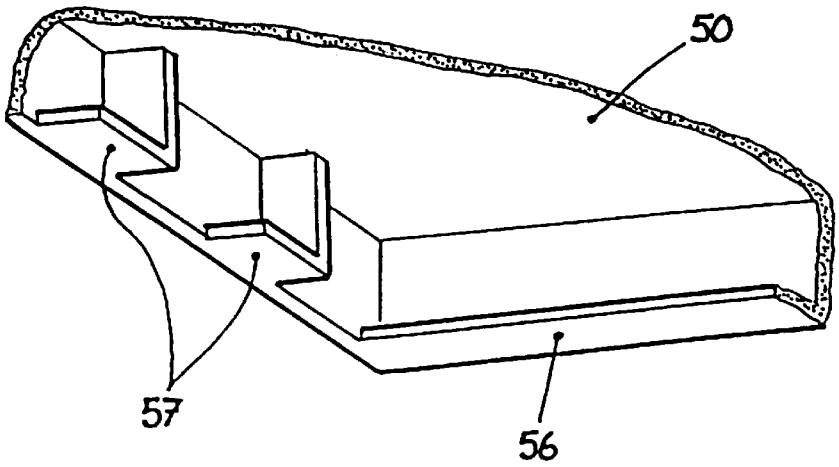
Fig. 8.2
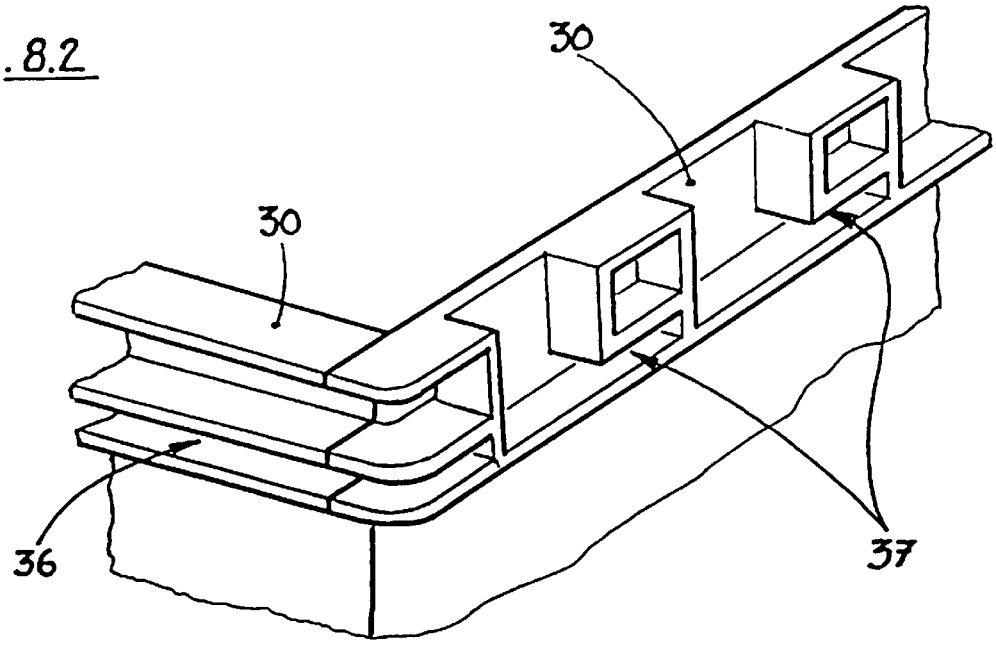

Fig. 9.1
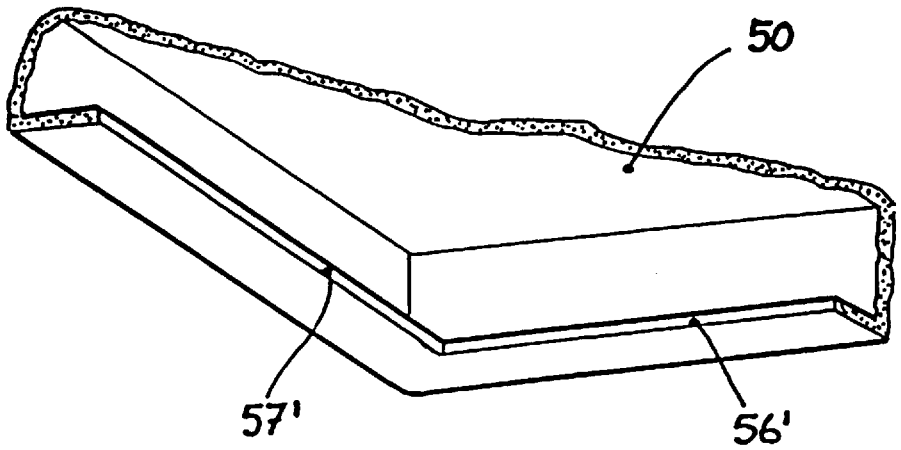
Fig. 9.2
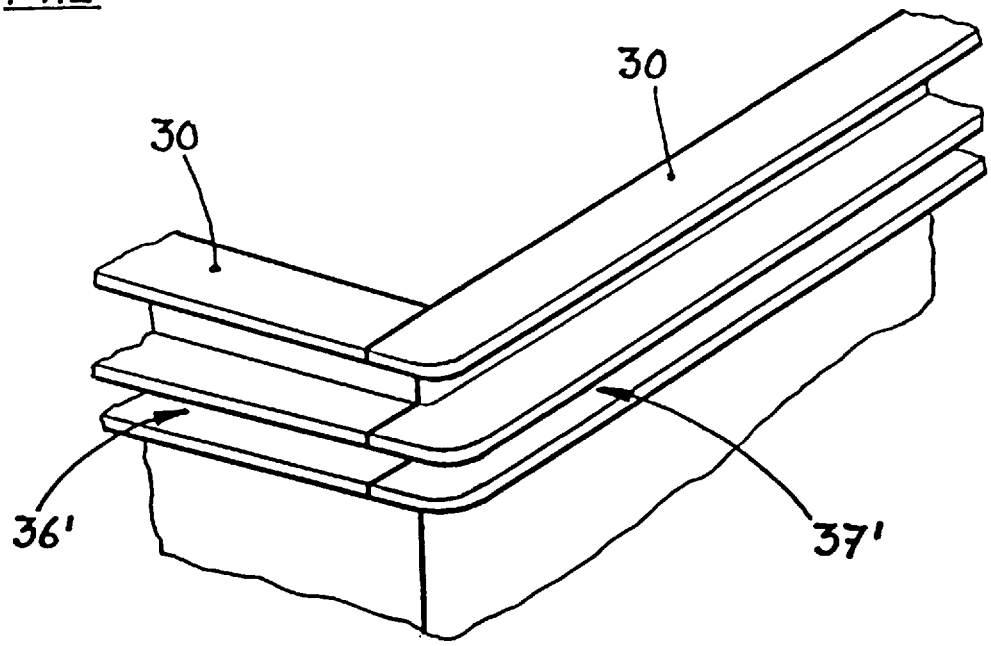

COLLAPSIBLE CONTAINER FOR TRANSPORT AND STORAGE OF FLUID AND PARTICULATE BULK GOODS

The present invention relates to collapsible container such as a collapsible pallet container for transport and storage of fluid and particulate bulk goods.

Collapsible containers of the foldable pallet container type, are rather popular since they will make a radical saving of the empty return transport volume possible. Foldable pallet containers are advantageously made of thermoplastic materials which will give light and still sturdy containers which are easy to keep clean. Another advantage is that the tare-weight of such containers is very stable which is not the case with, for example, wood containers where the tare-weight can double when the wood becomes wet. Yet another advantage is that thermoplastic materials do not corrode, which is the case with containers made from metal such as steel and aluminium. Most thermoplastic materials furthermore have a good resistance to chemical substances such as acids and bases, which is not the case with most metals.

A pallet container will have to cope with a vast number of different mechanical strains during its life cycle, and there are some cases where foldable pallet containers of thermoplastic material have not been possible to use due to un-favourable cases of load. One example is handling of fluent and particulate bulk goods since it causes forces and mechanical strain on the container which is difficult to predict, especially in load cases where the container is accelerated, retardated or even more so, when the container is exposed to thrusts and chocks.

Handling of bulk goods is separated from case goods by the fact that it can be poured, pumped or ladled while case goods most often is picked. Mineral water can serve as an example of the differences between the two types of goods. The mineral water could either be supplied in tanks for pumping and pouring which would be regarded as bulk handling, or in bottles or cans, which would be regarded as case handling. As further examples of substances that can be bulk handled can be mentioned, fluid substances with various viscosity, particles, powders, grain, granulate or paste-like substances. Such substances can be further exemplified as chemicals for industrial use, semi-finished and finished products within the food industry, petro-chemical products such as oil, fuels and coal as well as plastic granulate.

Sealing problems between the different parts of the collapsible container will inevitably occur when handling powder, smaller particles and fluids. These sealing problems can be overcome by using a so-called liner which is placed on the inside of the erected container. This liner is advantageously given the shape of a completely closed bag with the same shape as the inner volume of the container. The liner is suitably provided with a filling socket at the upper side and an emptying socket at the lower side. The container must of course also be provided with a hole at the lower end making the emptying socket accessible from the outside.

A container filled with fluid will be exposed to a force, urging the side walls outwards which causes a very unfavourable strain on the parts that normally keeps the side walls together. The fluids, especially low-viscous ones, will move during transport depending on for example acceleration and retardation. This will, in addition to high strains on the parts that keep the side walls together, as well as on the lower hinges, also imply that the container must be provided with a lid which prevents the bag-shaped liner, with content, from "flowing" over the edge of the container. Since the lid will be exposed to forces coming from below it will have to be attached to the container to prevent it from being forced upwards.

If a pallet container, containing fluid, is handled carelessly by being lowered too hasty, or even dropped, the risk becomes great that the parts that keep the side walls together will break due to the forces caused by the inertia of the fluid mass. Such a crash will probably also cause ruptures in the liner so that the contents will start to leak from the crashed container. This will of course cause some inconveniences but can also be hazardous if the container is used for transporting dangerous goods.

It has, through the present invention, been made possible to solve the above mentioned problem so that a collapsible container can be used for the handling of fluid and particulate bulk goods. The invention relates to a collapsible container, preferably a collapsible pallet container for transport and storage of fluent and particulate bulk goods, which container includes a carrying base part, collapsible side walls, preferably a so called liner in the form of a bag shaped inner layer and preferably a lid. The side walls are movably attached to the base part via hinge parts. Adjacent side walls are furthermore inter-connectable. The invention is characterised in that;

a) the base part is provided with shock absorbing members such as energy absorbing shock absorbers, deformation zones or the like, whereby a collapse of the carrying part and the side walls in which a leak could appear in connection to heavy blows or if the container is dropped, is prevented, and/or, b) that the connection between adjacent side walls is angularly flexible around a vertical pivot axle by providing the vertical connection line with a hinge-like design, or by providing the side walls with vertical flexible members in connection to the adjacent edges, and/or, c) that the container, during transport and/or storing, is provided with a lid which is mechanically connected with the side walls so that forces can be absorbed in both the vertical and the horizontal plane.

One load case that can be considered very unfavourable is when a container falls so that one of the lower edges will be the first point to hit the ground. The kinetic energy in the fluid will cause a number of shock waves towards the different parts of the container. The most forceful of the shock waves will be the one directed towards the side wall located directly above the lower edge that is the last to hit the ground. Most known pallet containers will break when being exposed to this type of load case.

The base part preferably has the basic shape of a pallet provided with feet and skids wherein the shock absorbing members mainly are constituted by the feet. The shock absorbing members can either be constituted by resilient designs such as coil springs, elastic pressurised gas bags, rubber blocks and the like, or deformation zones like the ones used in cars. Deformation zones can for example be constituted by ribs or profiles provided with indication of fracture or folding indication calculated to fold or break when exposed to a certain load. In cases where deformation zones are used, it will be necessary to replace parts of the container when an accident occurs. The probability for a leak will however be radically reduced, which is important since the economical value of the content, in most cases is much higher than the value of the container itself. The probability of personal injuries and environmental accidents will also be radically reduced when the container is used for transport of hazardous goods. Hazardous goods can for example be flammable or oxidising substances, toxical substances, corrosive substances, carcinogenic and mutagenic substances.

The collapsible container can also be provided with a device for heating. Such a device can for example be constituted by plates arranged on the base and/or sides of the container. The heating device is suitably supplied with electrical energy but can also be constituted by tubes with a heated circulating fluid or gas. Such a heating device is used when the content of the container is solid or highly viscous at normal room temperature. As an example of such possible contents can be mentioned chocolate, certain vegetable oils, certain waxes and resins.

A heating device supplied with electrical energy can for example be constituted by a thermoplastic material filled 20–70% of an electrically conductive filler such as graphite nodules, carbon fibre, steel fibre or the like. The thermoplastic material is suitably constituted by materials such as polyethylene, polypropylene, polybutene, polyamide, polycarbonate, polyalkylene-therephtalate, polyvinylchloride or the like. The thermoplastic/filler mixture is suitably given the shape of plates which are connected to a electrical conductor so that a current will flow through the plate which then will serve as a heating element. Such plates can also be integrated with the different parts of the container. It is possible to avoid some known disadvantages with this type of heating element by integrating it with the container. The foremost disadvantage is that graphite, that is the material most suited for use in this type of heaters, normally smears rather heavily. It is of course possible to use a liner on such heaters with for example a thermoplastic foil to avoid smearing when dismountable heaters are desired.

The graphite nodules, carbon fibres etc. will, due to the thermal expansion in the thermoplastic material, be separated from each other when the temperature rises. The electrical resistance in the heater will therefore also rise which will make the heater self guiding. The need of any guiding electronics can hereby be decreased or completely avoided. It is possible to achieve different temperature ranges by increasing or decreasing the filler content. It is hereby also possible to adapt the heater to the voltage supply that is at hand, for example 12 or 24 V in vehicles.

Collapsible container according to above are preferably manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrenecopolymer, polyamide, polycarbonate or the like. Since the desired material characteristics of the different parts that the container is made up of can vary from part to part it is possible to add different additives to the thermoplastic material that will make this possible. As examples of such known additives can be mentioned ethylene-vinyl-acetate and rubber beads which will make the material more ductile and more impact resistant, but on the other hand more disposed to thermal creepage, or glass fibre, carbon fibre, steel fibre or aramide fibre which will make the material more rigid, less disposed to thermal creepage but on the other hand more brittle.

According to one embodiment of the invention the side walls are provided with ring- or hoop-shaped receiving means at their respective adjacent ends, which receiving means are intended to receive locking bolts which are inserted into the receiving means when locking the side walls to each other in a raised position. The locking bolts are suitably connected with each other so that they together forms an inter-connection means, one for each vertical corner of the container. An angularly flexible connection of the side walls is hereby obtained.

According to an alternative embodiment of the invention the side walls are provided with rigid end members, flexible elastic members adjacent to these end members and an intermediate section placed between the elastic members, whereby a potential angular change in the corners can be absorbed by the elastic members. The different parts that together constitute the side wall can for example be manufactured from different materials that afterwards are assembled into a complete side wall. It is possible to manufacture the flexible members of an elastic material in a first mould. This pre-fabricated part is then put into a second mould, which gives the complete shape of the side wall. This second mould is then filled with a thermoplastic material with the desired rigidity. The pre-fabricated part will hereby be integrated with the rest of the side wall. Since the thermoplastic materials normally used for making containers normally are flexible or ductile to some extent it is possible to make the whole side wall from one and the same material by giving the flexible members the shape of a bellow. Among the thermoplastic materials normally used, the polyolefin group is included which includes polyethylene, polypropylene and polybutene.

The collapsible container is preferably provided with a lid when transported or stored. The lid is mechanically connected to the side walls of the container. The lid prevents the upper edge of the side walls of the container from bulging outwards which normally is caused by the pressure of a fluid or semi-fluid content. The lid suitably includes a foldable part intended to be used as a service hatch. It will then be possible to check the content or empty the container without having to remove the lid. The lid can also be mounted onto the container before the filling commences.

According to one embodiment of the invention the lid is provided with gripping lid coupling members in at least two opposite edges which coupling members are intended to interact with corresponding rim coupling members at the upper edge of the side walls.

According to an alternative embodiment of the invention the lid is parted into two inter-connectable parts. The edges of the lid adjacent to the upper edge of the side walls are provided with inward directed tracks, girders or hooks intended to interact with groves or slots at the upper edge of the side walls. The lid parts are slided into position from each of an opposite side and coupled together with one or more coupling means.

The liner is preferably folded in a special pattern before filling, which special pattern allows it to unfold automatically to the desired shape when being filled. The unfilled liner is suitably given the form of a cassette with a filling socket placed easy to reach at the top of the cassette. The cassette is installed on one of the side walls by means of a guiding and holding cassette holder which is constituted by an integrated part or a removable, temporary, part, of which the latter is to be removed at the later stages of the filling or when the filling is completed.

The invention is illustrated further through the enclosed figures showing different embodiments of the invention whereby, FIG. 1 shows in perspective, a collapsible container 1 in the form of a collapsible pallet container.

FIGS. 2 and 3 show in perspective, a part of a base part 20 with shock absorbing members 21 in the form of deformation zones, before and after deformation.

FIGS. 8.1–8.2 show in perspective a part of a lid 50 and the upper parts of two adjacent side walls 30.

FIGS. 9.1–9.2 show in perspective a part of a lid 50 and the upper parts of two adjacent side walls 30 according to an alternative embodiment of the invention.

Figure 1:
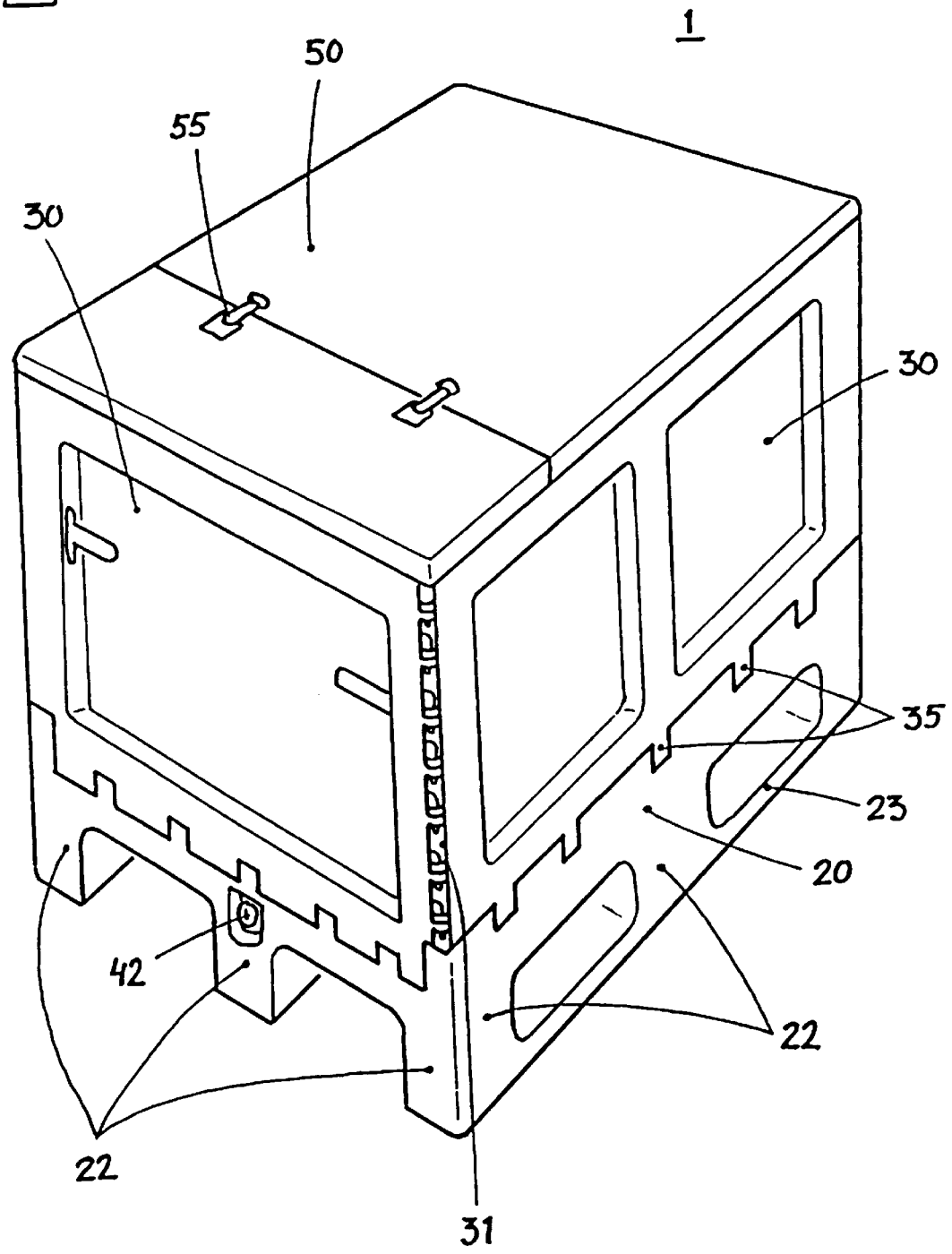

FIG. 1 shows in perspective a collapsible container 1 in the form of a collapsible pallet container. The collapsible container 1 is intended for transport and storage of fluid and particulate bulk goods. The collapsible container 1 includes a carrying base part 20, foldable side walls 30, a so called liner (not shown) in the form of a bag shaped inner layer and a lid 50. The side walls 30 are moveably attached to the base part 20 via hinge part 35. Adjacent side walls 30 are connectable. The connection between the side walls 30 is angularly flexible around a vertical pivot axis by being given a hinge-like design. The side walls 30 are at their respective vertical adjacent edges 31 provided with ring- or hoop-shaped receiving means 32, 33 (FIG. 5) into which locking bolts 34' (FIG. 5) are inserted when the side walls 30 are locked in the erected position. A number of locking bolts 34' are connected with each other into one inter-connection means 34 (FIG. 5) for each of the four vertical corners of the container 1. The connection between adjacent side walls 30 will hereby be angularly flexible around a vertical pivot axis whereby an angle a (FIG. 5) between two adjacent side walls 30 is allowed to deviate from the ideal angle of about 90°. Such a deviation of the angle a occurs when the side walls 30 bulges outwards due to the force exerted by the contents. This type of force will, in traditional types of collapsible pallet containers exert a breaking action upon the connection means between the side walls.

The base part 20 is given the shape of a pallet with feet 22 and skids 23. The feet 22 constitute shock absorbing members 21 in the form of deformation zones.

The lid 50 is separated into two interconnectable parts, which parts are brought into position from each of the two opposite short sides of the container 1. The two parts are kept together with a number of coupling means 55.

The liner (not shown) is provided with a filling socket (not shown) which is placed under the lid 50 near the top of a first short side. An emptying socket 42 is placed adjacent to the bottom at the same side as the filling socket.

Figure 2:
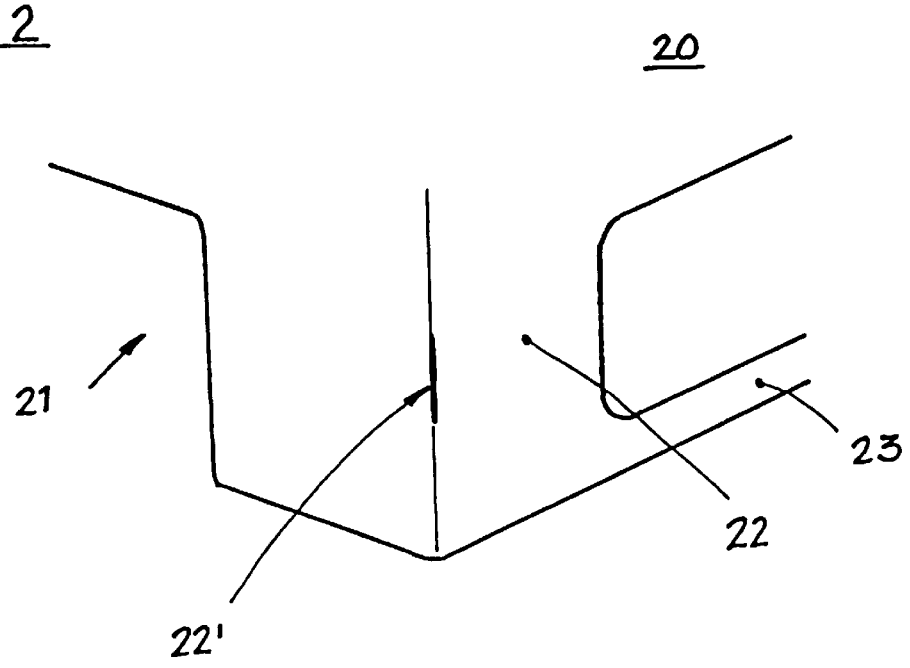
Figure 3:
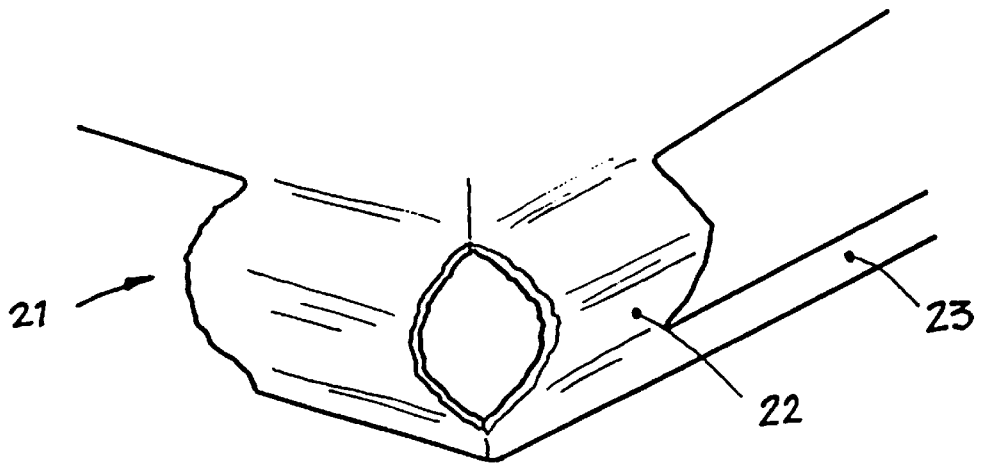

FIG. 2 shows in perspective view an embodiment of a base part 20 with shock absorbing members 21 in the form of deformation zones. Only a part of the base part 20 is shown. The FIG. 2 shows the base part 20 before deformation. The base part 20 has the basic shape of a pallet with feet 22 and skids 23. FIG. 3 shows the base part 20 after bringing it to fall so that a first impact was brought onto the foot 22 shown. The shock absorbing member 29 was as planned deformed by the impact. The feet 22 are provided with tuned indication of fracture 22' (FIG. 2) which will serve as a starting point of the fracture, and hence the deformation. The feet 22 are given the shape of hollow profiles with a mainly rectangular cross-section. The feet 22 are further provided with vertical inner support walls which for the reason of simplicity are not shown. The inner support walls are also provided with indications of fracture.

Figure 4:
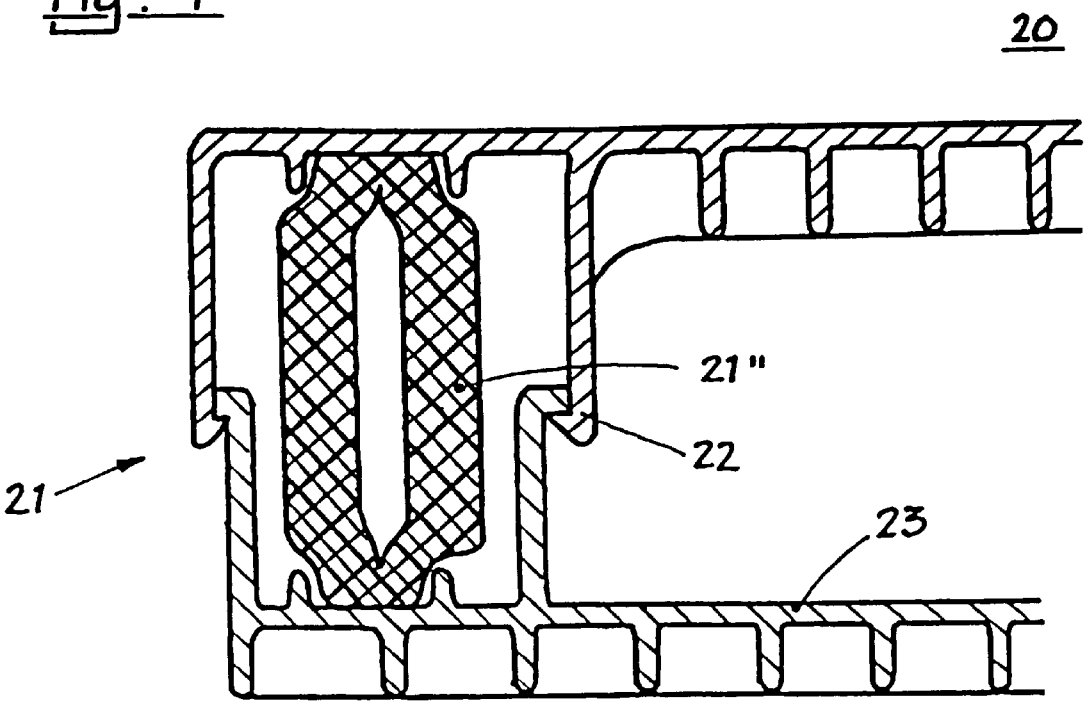
FIG. 4 shows in cross-section, a second embodiment of a base part 20 with shock absorbing members 21 in the form of energy absorbing shock absorbers.

FIG. 4 shows in cross-section a second embodiment of a base part 20 with shock absorbing members 21 in the form of energy absorbing shock absorbers 21". Only a part of the base part 20 is shown, for the reason of simplicity. The base part 20 is provided with feet 22 and skids 23. The feet 22 is constituted by an upper part which is manufactured as a part integrated with the upper of the base part 20 while the lower part of the feet is manufactured as a part integrated with the skids 23. The lower part of the feet 22 runs telescopically in the upper part of the feet 22. The feet 22 are hollow and a shock absorber 21" is arranged in the hollow space.

The rigidity of the shock absorber 21" is selected so that the height of the feet 22 is reduced only by a fraction during normal load conditions, bearing in mind that a number of pallet containers 1 can be stacked on top of each other. The shock absorbers 21" are suitably manufactured of a rubber material which will return to its original shape after being exposed to a shock. It is, however, also possible to use any other type of material where the deformation remains after shock. In this case the shock absorber will have to be replaced after an accident. The advantage with a shock absorber where the deformation remains is that it will become easier to, by design, control the shock absorption so that a more gentle absorption of the kinetic energy is achieved. It will hereby also be possible to control or avoid unwanted bouncing effects.

Figure 5:
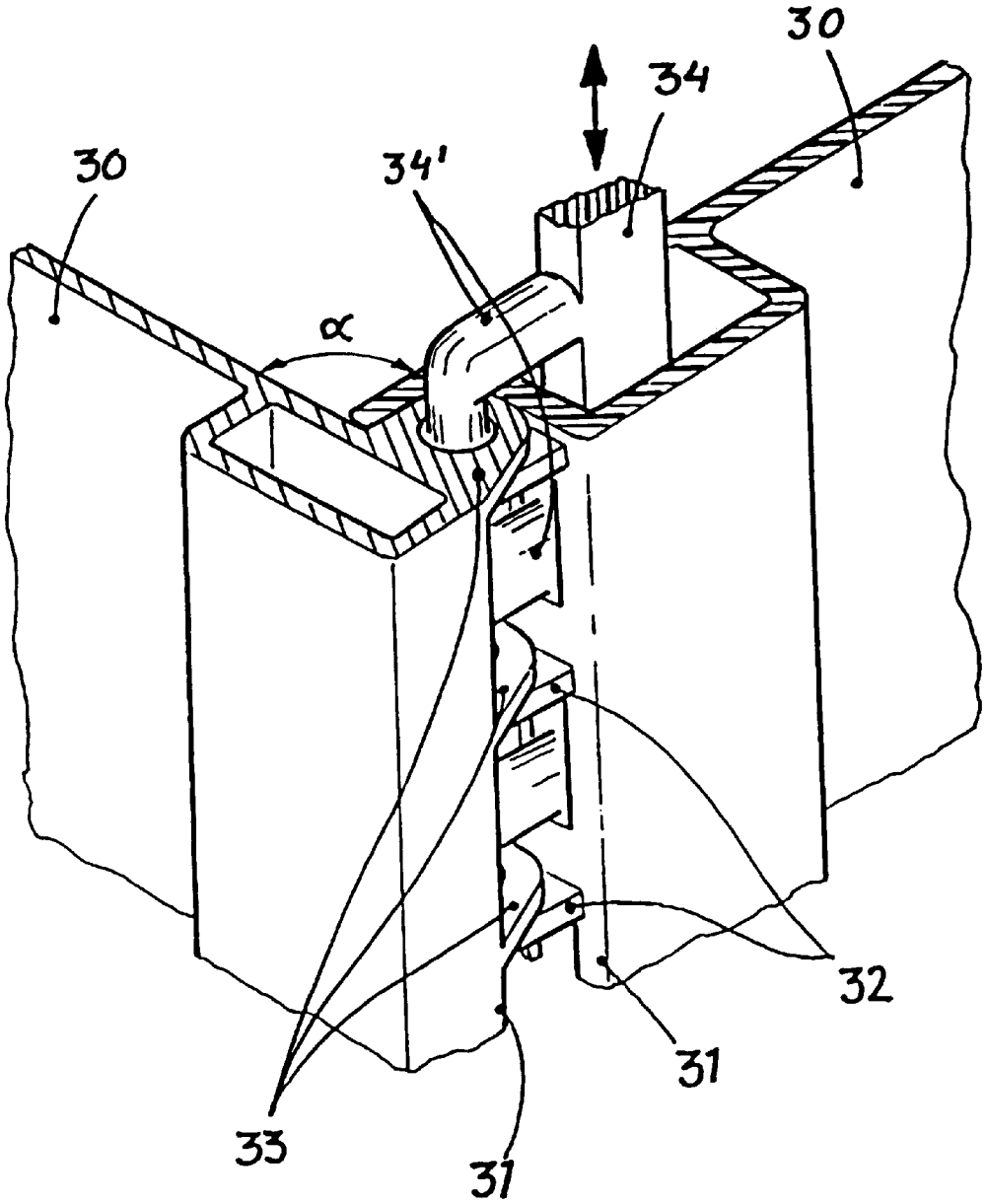
FIG. 5 shows in perspective a part of a flexible coupling between two adjacent side walls 30.

FIG. 5 shows in perspective a part of a flexible connection between two adjacent side walls 30. The connection between the two adjacent side walls 30 is angularly flexible by being given a hinge-like design. The side walls 30 are provided with ring- or hoop-shaped receiving means 32, 33 at their respective vertical ends of the side walls 30. The receiving means 32, 33 are intended to receive locking bolts 34' when locking the side walls 30 in the erected position. A number of locking bolts 34' are connected with each other into an interconnection means 34, one for each vertical corner of the container. The connection between adjacent side walls 30 will hereby be angularly flexible around a vertical pivot axis whereby an angle a between the two adjacent side walls 30 is allowed to increase from the ideal angle of about 90°. Such an increase of the angle a occurs when the side walls 30 bulges outwards due to the force exerted by the contents. This type of force will, in traditional types of collapsible pallet containers exert a breaking action upon the connection means between the side walls which for example at acceleration, retardation or when dropped can cause the connection to break.

Figure 6:
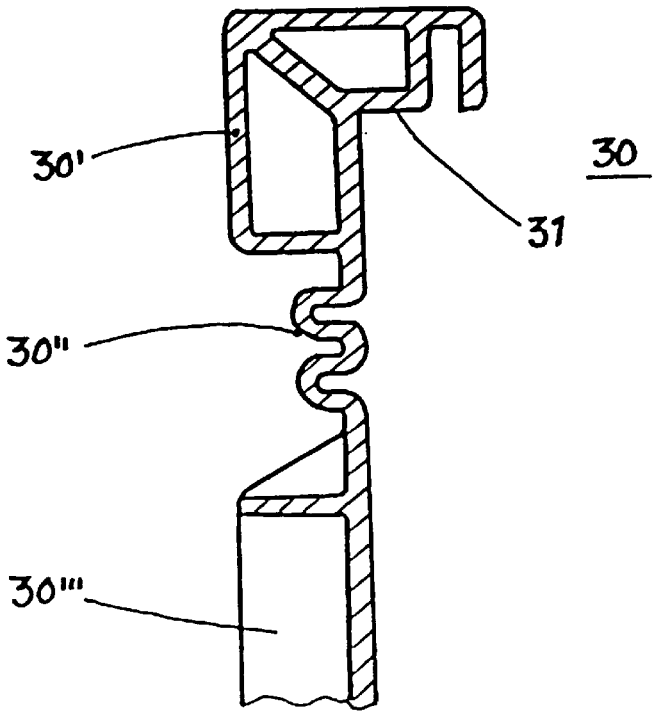
FIG. 6 shows in cross-section, an embodiment of side wall 30.

FIG. 6 shows in cross-section an alternative embodiment of a side wall 30. The side walls 30 are provided with rigid edge members 30' at their respective vertical edges 31. A flexible elastic member 30" is arranged adjacent to each of the rigid edge members 31' and an intermediate section 30'" between the two elastic members 30". The flexible elastic members 30" are given the design of a bellow which allows a certain flexibility. A potential angular deviation in the vertical corners can hereby be absorbed by the flexible elastic members 30".

Figure 7:
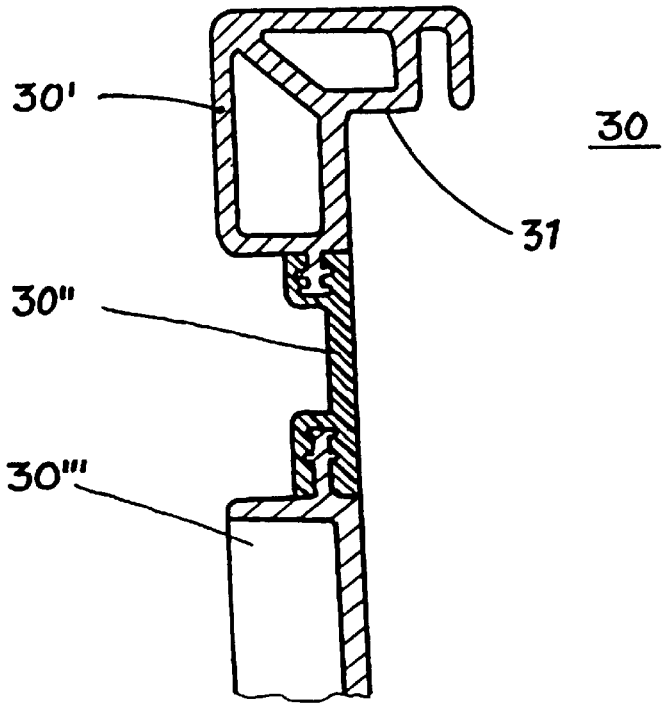
FIG. 7 shows in cross-section, another embodiment of a side wall 30.

FIG. 7 shows in cross-section another alternative embodiment of a side wall 30. The side walls 30 are provided with rigid edge members 30' at their respective vertical edges 31. A flexible elastic member 30" is arranged adjacent to each of the rigid edge members 31' and an intermediate section 30'" between the two elastic members 30". A potential angular deviation in the vertical corners can hereby be absorbed by the flexible elastic members 30". The different members can be manufactured separately from different materials which later are assembled into a complete side wall 30. The flexible elastic members 30" are hereby manufactured of an elastic material. This pre-fabricated part is then put into a mould which gives the shape for the whole side wall 30. The mould is then filled with a thermoplastic material with the desired mechanical characteristics such as rigidity. The pre-fabricated part will hereby be integrated with the rest of the side wall 30.

FIG. 8.1 shows in perspective a part of a lid 50 seen from below. FIG. 8.2 shows in perspective parts of two adjacent side walls 30. The lid 50 is provided with lid coupling members in the form of inwards directed tracks 56 which are intended to interact with corresponding grooves 36 (FIG. 8.2) placed on the upper edge of the short side walls 30. The lid 50 is further provided with lid coupling members in the form of inward directed hooks 57 at the long side edges. These hooks 57 are intended to interact with corresponding hook grooves 37 (FIG. 8.2) at the upper edge of the long side walls 30. The lid 50 is constituted of two parts which are applied onto the container from above with the short side slightly outside the edge of the short side walls 30 of the container. The lid parts are then slided horizontally towards each other, and thereby towards the opposite side wall 30 of the container 1, so that the tracks 56 and hooks 57 respectively interact mechanically with the grooves 36 and the hook grooves 37 respectively. The lid parts are then are hereafter coupled together by means of coupling means 55 (FIG. 1). The coupling is suitably constituted of an expander lock.

The FIGS. 9.1–9.2 show in perspective a part of a lid 50 seen from below and the upper parts of two adjacent side walls 30 according to an alternative embodiment of the invention. The lid 50 is provided with lid coupling members in the form of an inwards directed track 56'. This track 56' is intended to interact with a corresponding grove 36' (FIG. 9.2) at the upper part of the short side walls. The lid 50 is further provided with lid coupling members in the form of an inwards directed girder 57' at the long side edges of the lid 50. These girders 57' are intended to interact with corresponding grooves 37' (FIG. 9.2) at the upper edge of the long side walls. The lid 50 is constituted by two parts which are slided horizontally towards each other from each of the two short sides of the container so that the tracks 56' and girders 57' respectively interact with the corresponding grooves 36' and 37' respectively. The lid parts are then are hereafter coupled together by means of coupling means 55 (FIG. 1). The coupling is suitably constituted of an expander lock.

The invention is not limited by the embodiments shown since they can be altered in different ways within the scope of the invention. It is for example possible to provide the lid 50 with a foldable part that can be used as a service hatch.

What is claimed is:

1. Collapsible container (1), preferably a collapsible pallet container for transport and storage of fluent and particulate bulk goods, which container includes a carrying base part (20), collapsible side walls (30), preferably a so called liner in the form of a bag shaped inner layer and preferably a lid (50), whereby the side walls (30) are movably attached to the base part (20) via hinge parts (31) and that adjacent side walls (30) are inter-connectable, characterised in that the connection between adjacent side walls (30) is angularly flexible around a vertical pivot axle by providing the vertical connection line with a hinge-like design, or by providing the side walls (30) with vertical flexible members in connection to its adjacent edges (31), that the container (1), during transport and/or storing, is provided with a lid (50) which is mechanically connected with the side walls (30) so that forces can be absorbed in both the vertical and the horizontal plane and that the base part (20) is provided with shock absorbing members (21) such as energy absorbing shock absorbers, deformation zones or the like, whereby a collapse of the carrying part and the side walls in which a leak could appear in connection to heavy blows or if the container is dropped, is prevented.

2. Collapsible container (1) according to claim 1 characterised in that the base part (20) has the basic shape of a pallet provided with feet (22) and skids (23) wherein the shock absorbing members (21) are mainly constituted by the feet (22).

3. Collapsible container (1) according to claim 1 characterised in that the container (1) is manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrene copolymer, polyamide, polycarbonate or the like.

4. Collapsible container (1) according to claim 1, characterised in that the side walls (30) are provided with ring or hoop-shaped receiving means (32, 33) at their respective adjacent ends (31), which receiving means (32, 33) are intended to receive locking bolts (34') which are inserted into the receiving means (32, 33) when locking the side walls to each other in a raised position, and that a number of locking bolts (34') together form an interconnection means (34), one for each vertical corner of the container, whereby an angularly flexible connection of the side walls (30) is received.

5. Collapsible container (1) according to claim 1 characterised in that the side walls (30) are provided with rigid end members (30'), flexible elastic members (30") adjacent to the end members (30') and an intermediate section (30'") placed between the elastic members (30"), whereby a potential angular change in the corners can be absorbed by the elastic members (30").

6. Collapsible container (1) according to claim 1 characterised in that the lid (50) includes a foldable part intended to be used as a service hatch.

7. Collapsible container (1) according to claim 1 characterised in that the lid (50) is provided with gripping lid coupling members in at least two opposite edges which coupling members are intended to interact with corresponding rim coupling members at the upper edge of the side walls (30).

8. Collapsible container (1) according to claim 1 characterised in that the lid (50) is parted into two interconnectable parts and that the edges of the lid (50) adjacent to the upper edge of the side walls (30) is provided with inward directed tracks, girders or hooks intended to interact with groves or slots at the upper edge of the side walls, whereby the lid parts are slided into position from each of an opposite side and coupled together with one or more coupling means (55).

9. Collapsible container (1) according to claim 1 characterised in that the liner is folded in a pattern before filling, which pattern allows it to unfold automatically to the desired shape when being filled.

10. Collapsible container (1) according to claim 9 characterised in that the unfilled liner is shaped as a cassette with a filling socket placed easy to reach at the top of the cassette, and that the cassette is installed on one of the side walls (30) by means of a cassette holder which is constituted by an integrated part or a removable, temporary, part, of which the latter is to be removed at the later stages of the filling or when the filling is completed.

* * * * *